US011236554B2

(12) United States Patent
Romero

(10) Patent No.: US 11,236,554 B2
(45) Date of Patent: Feb. 1, 2022

(54) WELL SERVICING LIFT APPARATUS

(71) Applicant: Tuttie's Machine & Supply, Inc., New Iberia, LA (US)

(72) Inventor: Keith Romero, New Iberia, LA (US)

(73) Assignee: TUTTIE'S MACHINE & SUPPLY, INC., New Iberia, LA (US)

( * ) Notice: Subject to any disclaimer, the term of this patent is extended or adjusted under 35 U.S.C. 154(b) by 0 days.

(21) Appl. No.: 16/754,185

(22) PCT Filed: Oct. 10, 2018

(86) PCT No.: PCT/US2018/055189
§ 371 (c)(1),
(2) Date: Apr. 7, 2020

(87) PCT Pub. No.: WO2019/075043
PCT Pub. Date: Apr. 18, 2019

(65) Prior Publication Data

US 2021/0189808 A1 Jun. 24, 2021

Related U.S. Application Data

(60) Provisional application No. 62/570,170, filed on Oct. 10, 2017.

(51) Int. Cl.
*E21B 19/06* (2006.01)
*E21B 33/068* (2006.01)

(52) U.S. Cl.
CPC ..... *E21B 19/06* (2013.01); *E21B 33/068* (2013.01)

(58) Field of Classification Search
CPC ..... E21B 19/00; E21B 19/06; E21B 19/087; E21B 15/00; E21B 33/068
See application file for complete search history.

(56) References Cited

U.S. PATENT DOCUMENTS 3,533,516 A * 10/1970 Guier ..... E21B 19/14 414/22.51
10,329,874 B2 * 6/2019 Wright ..... E21B 21/10
2003/0034157 A1 * 2/2003 Mullins ..... E21B 21/01 166/77.52
2011/0147008 A1 * 6/2011 Brown ..... E21B 19/08 166/377

* cited by examiner

*Primary Examiner* — Cathleen R Hutchins
*Assistant Examiner* — Ronald R Runyan
(74) *Attorney, Agent, or Firm* — Law Office of Jesse D. Lambert, LLC

(57) ABSTRACT

An apparatus for lifting, lowering and positioning well servicing apparatus relative to an oil or gas well is disclosed. A tubular main body is mounted in an operative position relative to a wellbore, by a bolted flange, clamp or other means. A lift arm having a vertical arm section and a horizontal arm section is slidably disposed in said main body and movable vertically and rotationally. A hydraulic cylinder, preferably positioned within the main body, moves the lift arm vertically up and down. Desired rotation is achieved by the interaction of a guide pin or cam follower, disposed in the main body and extending into a slot pattern on the outer surface of the vertical arm section, as the lift arm is moved vertically by the hydraulic cylinder. The apparatus can be used to position a safety "night cap," a ball drop mechanism, or other tools on a well.

7 Claims, 11 Drawing Sheets

WELL SERVICING LIFT APPARATUS

CROSS REFERENCE TO RELATED APPLICATIONS

This non-provisional patent application claims priority to U.S. provisional patent application Ser. No. 62/570,170, filed Oct. 10, 2017, for all purposes. The disclosure of that application is incorporated herein, to the extent not inconsistent with the disclosure of this application.

BACKGROUND—FIELD OF THE INVENTION

This invention relates to apparatus used in connection with the servicing of oil and gas wells.

After a well has been completed, it is frequently required to carry out work on the well over its lifetime. Various equipment must be installed atop the wellhead to carry out such work. While different arrangement may be used, a typical arrangement comprises a blowout preventer or BOP assembly atop the wellhead; an uppermost connection, which may be a pump in sub atop the BOP assembly; then a lubricator atop the uppermost connection (pump-in sub or the like).

When the service work must be shut down for a period of time, for example overnight, or when awaiting equipment, personnel, etc., a safety cap, frequently known as a "night cap," is installed on the uppermost threaded connection, which may be on top of the uppermost connection, which may be a pump in sub or any other connection, or alternatively on top of the BOP assembly, or another piece of equipment. On all of these, an upwardly-facing threaded connection is provided. Even though all of the valves are closed, for safety reasons the uppermost safety cap, which is a relatively heavy cap with matching coarse threads, is made up on the uppermost threaded connection on the wellhead, pump in sub or other equipment. The safety cap also prevents debris from falling into the wellbore.

Problems arise in connection with lifting this heavy cap out of engagement with the wellhead or uppermost connection, holding it in an out-of the way position while service work is ongoing (usually by swinging it out of the way), then moving the cap back into position over the wellhead, uppermost connection or other equipment to once again be made up on such equipment. It can be appreciated that lifting and supporting this heavy cap, which is usually in an elevated position, is not only inconvenient but presents safety issues. At times, tools are attached to the safety cap and are lifted along with the safety cap. It is to be understood that tools other than safety caps may be lifted or otherwise positioned relative to the wellhead/wellbore.

The known prior art well servicing lift apparatus all present various issues, giving rise to a desire for an improved well servicing lift apparatus that addresses these issues.

SUMMARY OF THE INVENTION

A first embodiment of the well servicing lift apparatus embodying the principles of the present invention comprises a main body which mounts to a wellhead, an uppermost connection such as a pump-in sub or the like, for example by a mounting arm with a flanged connection or similar means, such as a clamp. The main body has a generally vertically disposed section with a bore. A lift arm has a vertical arm section slidably disposed in the bore of the main body, and a horizontal arm section, typically with an eye or similar structure, from which a line runs to a safety cap or other well servicing tool. A hydraulic cylinder, preferably positioned within the lower part of the main body, moves the lift arm vertically upward and downward. The lift arm, namely the vertical arm section thereof, comprises a slot on its outer surface, which engages a guide pin positioned within the bore of the main body. The slot has a desired shape, which forces the lift arm to rotate as it moves from its first, lowermost vertical position to its second, uppermost vertical position, thereby (once the safety cap is raised high enough to clear any equipment) rotating the safety cap out of the way of the wellhead or uppermost connection, permitting easy access for service work. In reverse, when the lift arm is lowered, the guide pin/slot interaction causes the lift arm and horizontal arm section to rotate so that the horizontal arm section aligns the safety cap with the wellhead or uppermost connection, then continues to lower the cap into place on the wellhead.

A second embodiment of the lift apparatus shares certain structural elements with the first embodiment, but additionally comprises a slot pattern on the vertical arm section of the lift arm which generates a desired rotational sequence, when the lift arm is raised and lowered by the hydraulic cylinder. This embodiment further comprises a spring biased, elongated cam follower disposed within the main body, with the elongated cam follower engaged in the slot pattern. The configuration of the slot pattern is such that the following sequence of movement can be achieved (i.e., a combination of vertical and rotational movement):

- by way of example, the starting position may be considered as the lift arm being in a first, lowermost vertical position, and in a first rotational position (e.g., aligned with the wellbore being serviced)
- as the lift arm is raised from the first vertical position to a second, uppermost vertical position, the interaction of the cam follower in the slot pattern rotates the lift arm from the first rotational position to a second rotational position, out of alignment with the wellbore being serviced (the rotation commencing once any well service equipment attached to the horizontal arm section of the lift arm has cleared other equipment, such as a guide funnel, etc.)
- next, the lift arm can be lowered back to the first vertical position, while remaining in the second rotational position (e.g. out of alignment with the wellhead/wellbore)
- next, the lift arm can be raised back to the second vertical position, and (via the interaction of the cam follower in the slot pattern) rotated back to the first rotational position (aligned with the wellhead/wellbore)
- next, the lift arm can be lowered back to the first vertical position, while remaining in the first rotational position The above sequence can be repeated as desired. The particular configuration of the slot pattern, including changes in the slot depth in different sections of the slot pattern and resulting ledges created in the slot pattern, coupled with the configuration of the cam follower, results in the desired rotational movement. If desired, the apparatus can comprise two (first and second) sets of the slot patterns, generally disposed 180 degrees from one another about the circumference of the vertical arm section of the lift arm. A second cam follower is provided to engage the second set of slot patterns. It is understood that any desired well servicing equipment can be attached to and suspended from the horizontal arm section of the lift arm, for example a night cap, a ball launch, or other equipment.

DESCRIPTION OF THE PRESENTLY PREFERRED EMBODIMENT(S)

A First Embodiment

While various safety cap lift apparatus can embody the principles of the present invention, with reference to the drawings some of the presently preferred embodiments can be described. Any dimensions on the drawings are by way of example only and not limitation.

Figure 1:
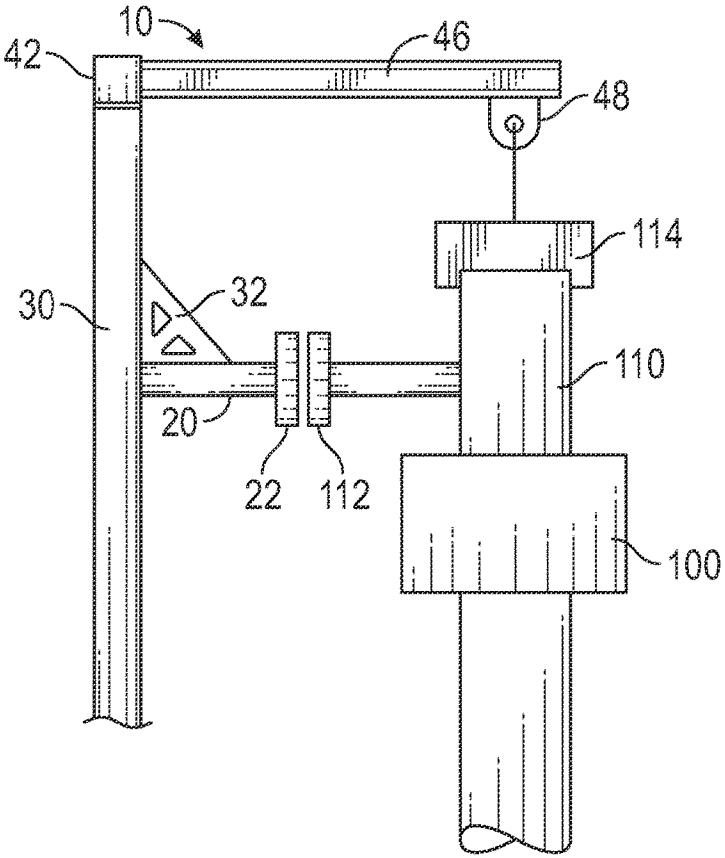
FIG. 1 is a view of a wellhead and uppermost connection (pump-in sub) in schematic form, along with an embodiment of the well servicing lift apparatus of the present invention.

FIG. 1 shows, in schematic form, a wellhead 100 and uppermost connection, for example a pump-in sub 110 mounted atop wellhead 100. Pump-in sub 110 comprises a flange 112, which serves as a mounting piece for the lift apparatus. Safety cap 114 is shown in place atop pump-in sub 110. It is understood that various arrangements of equipment may be used; the wellhead and pump-in sub are by way of example only. As noted, the uppermost connection may be a pump-in sub or any other equipment.

FIG. 1 also shows, in simplified form, the lift apparatus 10 mounted to wellhead 100 via flange 112 on pump-in sub 110. It is understood that various arrangements may be used to mount lift apparatus 10 to wellhead 100. While the flange-to-flange arrangement shown in FIG. 1 (and in other drawings) is a presently preferred embodiment, it is to be understood that other mounting arrangements may be used as well, such as the clamp arrangement later described herein.

Figure 2:
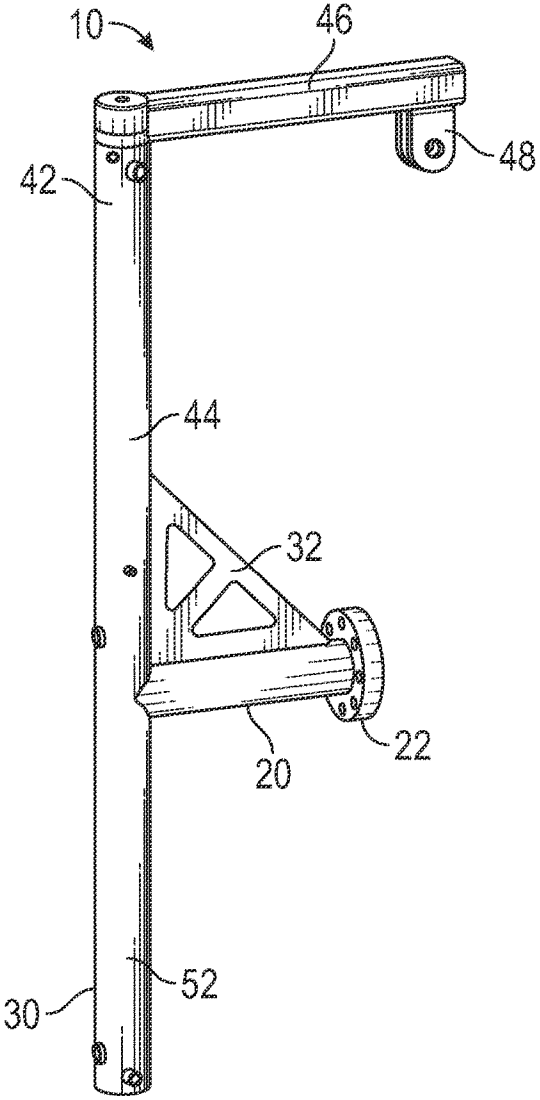
FIG. 2 is a perspective view of an embodiment of the well servicing lift apparatus embodying the principles of the present invention.
Figure 4:
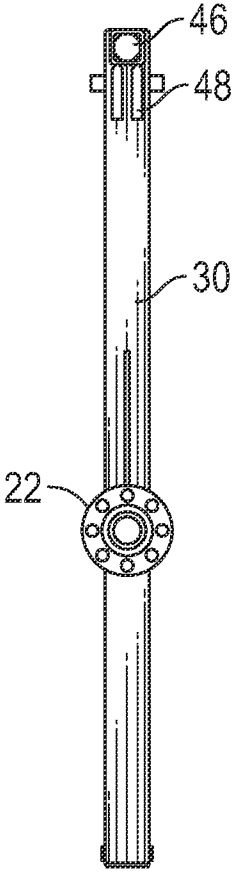
FIG. 4 is a view of of the well servicing lift apparatus of FIG. 3, turned 90 degrees.
Figure 3:
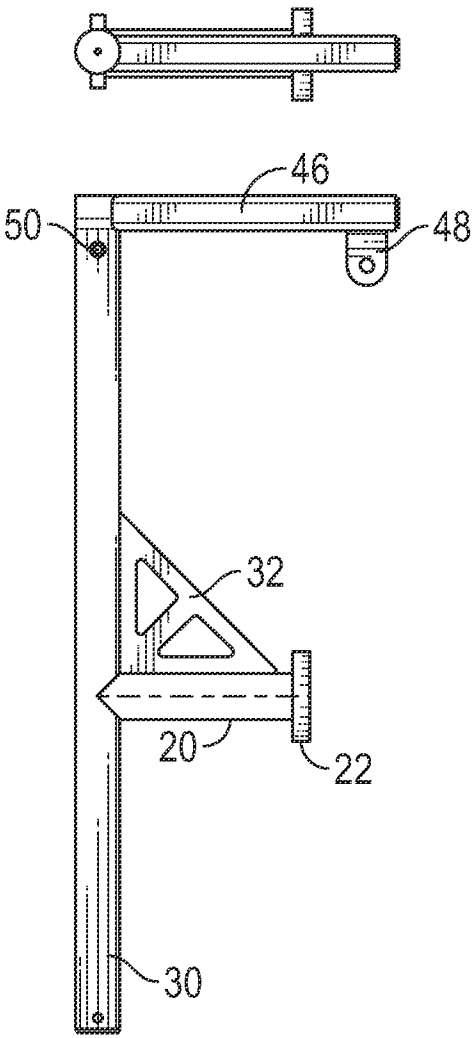
FIG. 3 is a side view of an embodiment of a well servicing lift apparatus embodying the principles of the present invention.
Figure 5:
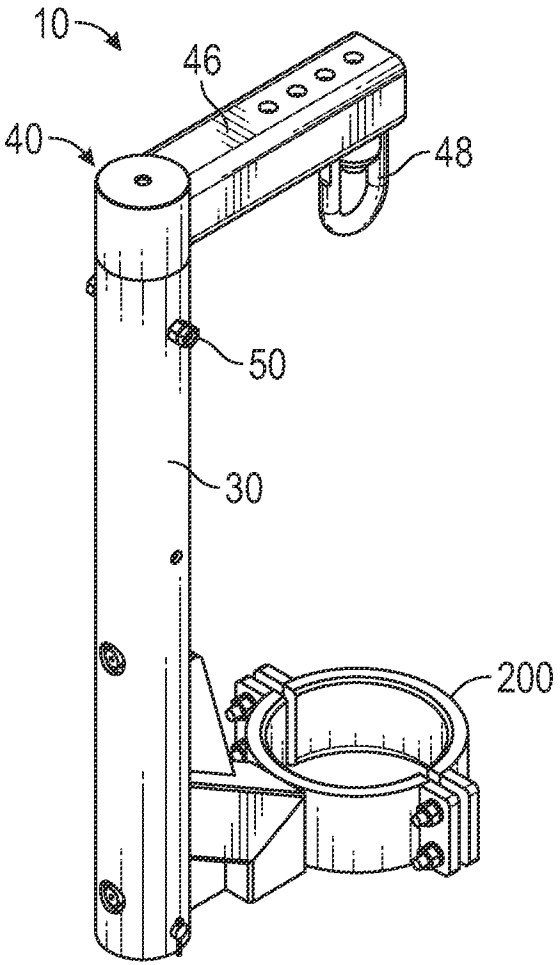
FIG. 5 is a perspective view of an embodiment of the well servicing lift apparatus, with the lift arm in its lowermost position.
Figure 4A:
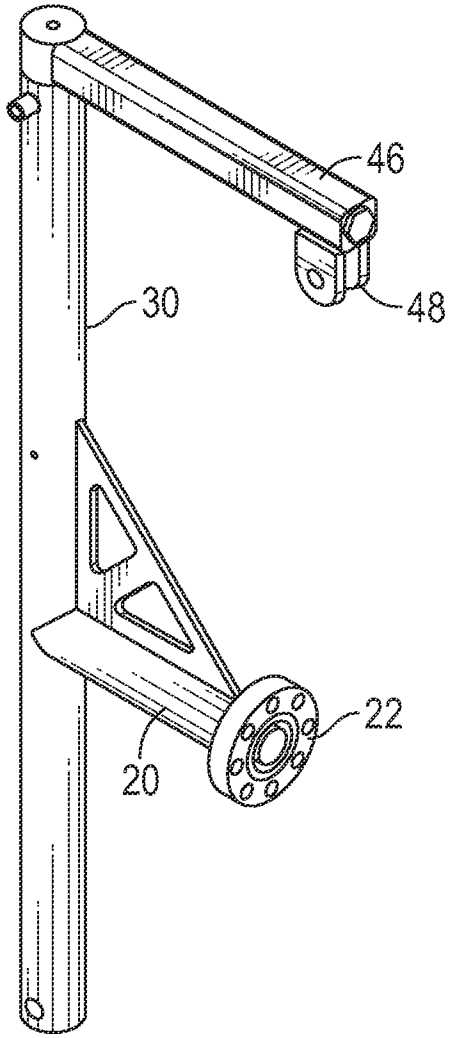
FIG. 4A is an isometric or perspective view of an embodiment of the apparatus.

FIG. 2 is a perspective view in partial cross section of an embodiment of lift apparatus 10. A generally vertically disposed main body 30 comprises a mounting arm 20, which may have a flange 22 thereon, for mounting to an uppermost connection, such as a pump-in sub, as shown in FIG. 1 and described above. A brace 32 may be provided. FIGS. 3, 4, and 4A also show an embodiment of the apparatus with the flanged connection. FIGS. 5-8 show an embodiment of the apparatus with a clamp connection 200. Other than the means of connecting the apparatus to the wellhead, both embodiments are otherwise structurally very similar.

With reference to the figures, main body 30 is preferably tubular with a central bore. Lift arm 40 is slidably disposed within the bore of main body 30, and may move up and down under the influence of hydraulic cylinder 52. Appropriate hoses, pressurized hydraulic fluid source, controls, etc. are provided, as is understood in the relevant art.

Figure 7:
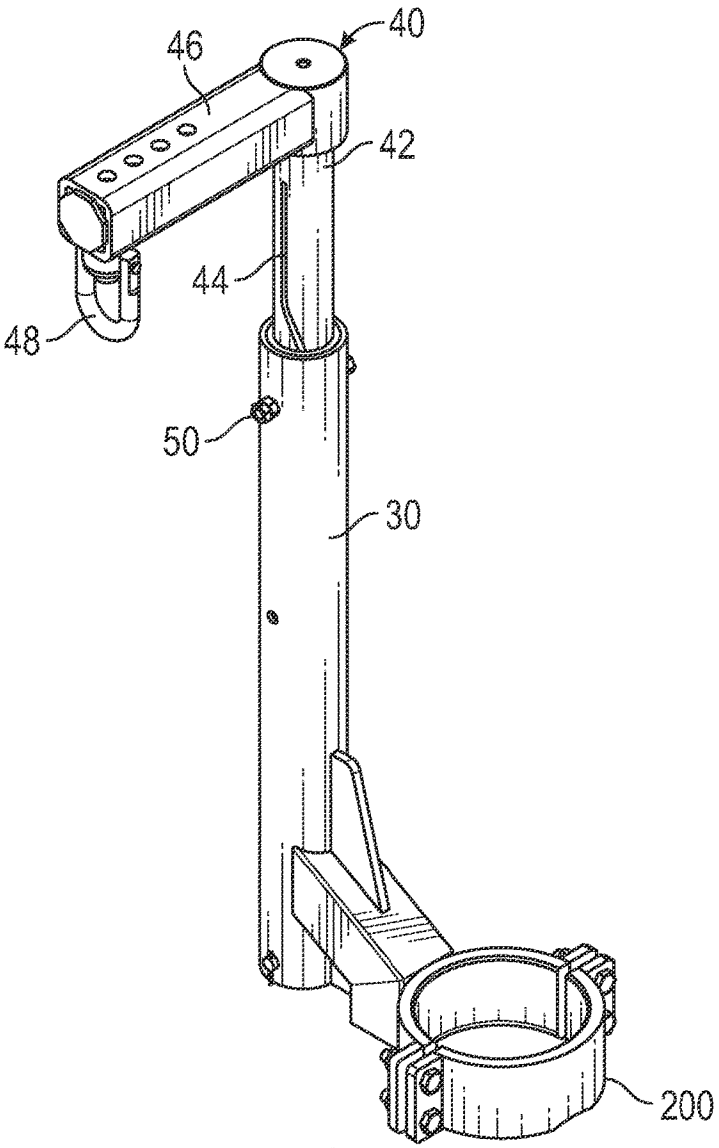
FIG. 7 is a perspective view of the embodiment of the well servicing lift apparatus of FIGS. 5 and 6, with the lift arm in its uppermost position and rotated so as to move the safety cap out of alignment with the wellhead.
Figure 8:
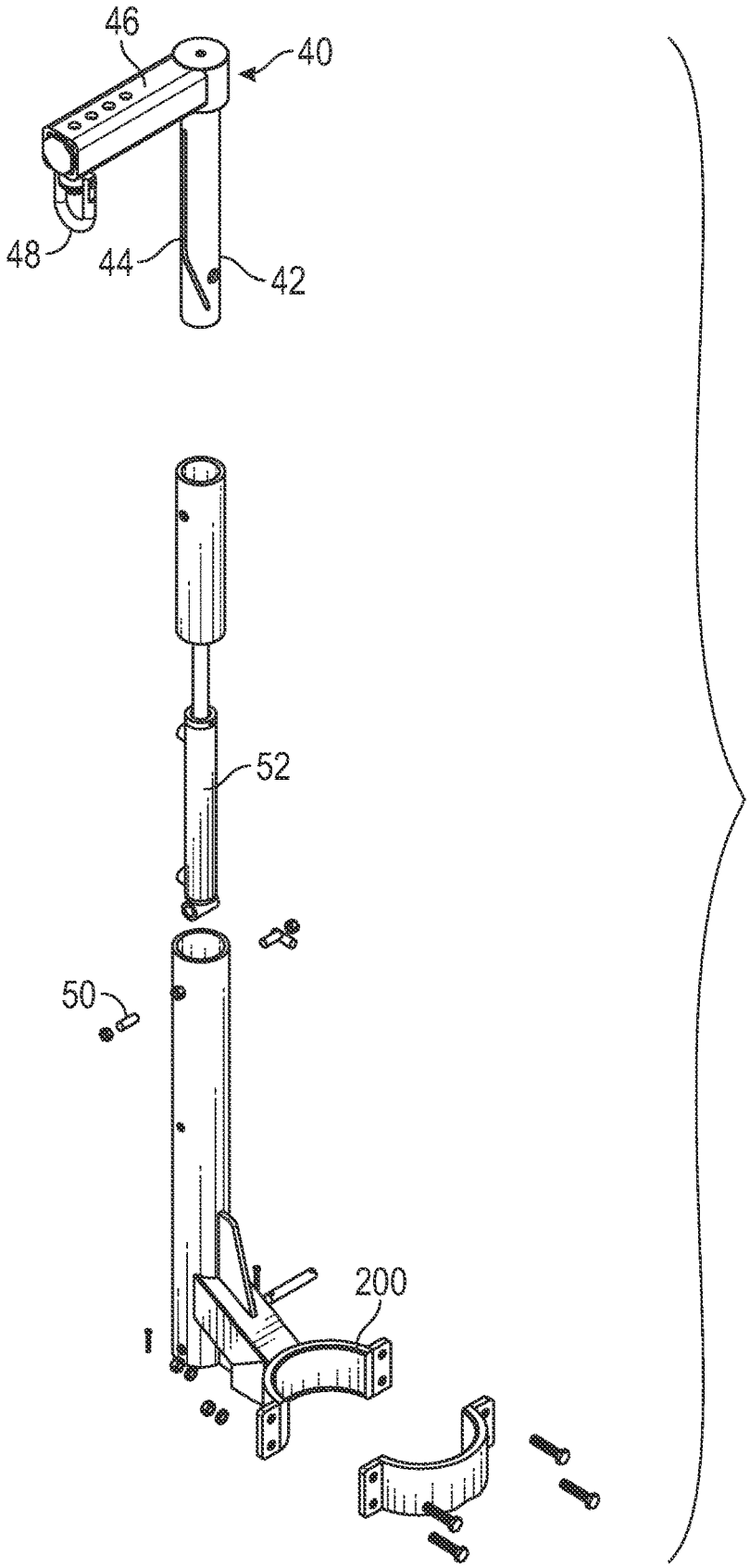
FIG. 8 is an exploded view of the embodiment of FIGS. 5-7.
Figure 9:
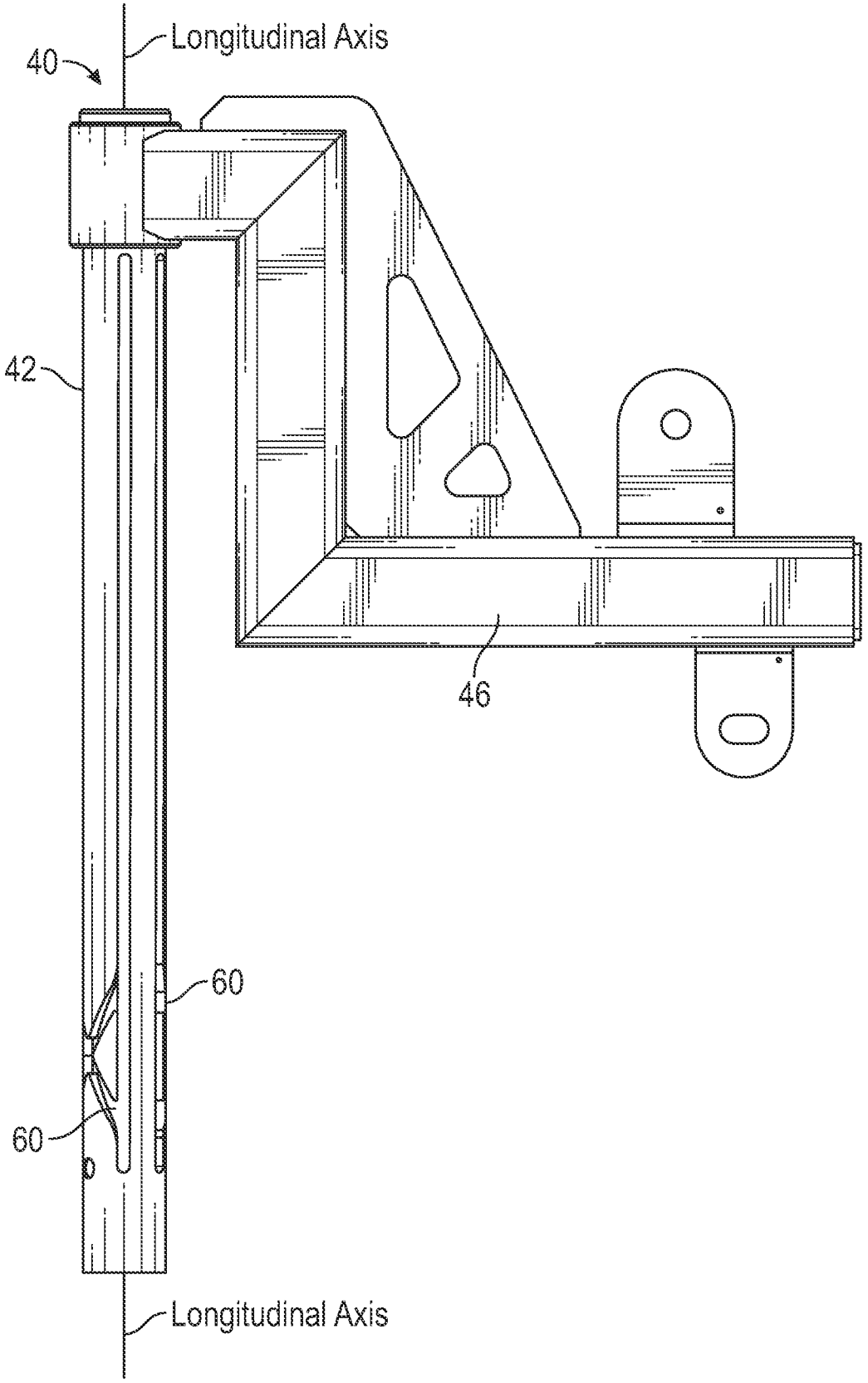
FIG. 9 is a side view of the lift arm of a second embodiment of the well servicing lift apparatus.

Lift arm 40 comprises a generally vertically positioned vertical arm section 42 joined to a horizontal arm section 46. Vertical arm section 42 comprises an appropriately shaped slot 44, which engages a guide pin 50 mounted in the bore of main body 30. As can be seen in the figures, slot 44 generally has a vertical section, i.e. parallel to the longitudinal axis of vertical arm section 42, with a lower section (as shown in FIG. 7 and FIG. 8) with a suitable angle and shape. An eye 48 or similar fixture on horizontal arm section 46 provides a location for a line, shackle, chain, etc. to be fastened, on which the safety cap can be attached.

Figure 6:
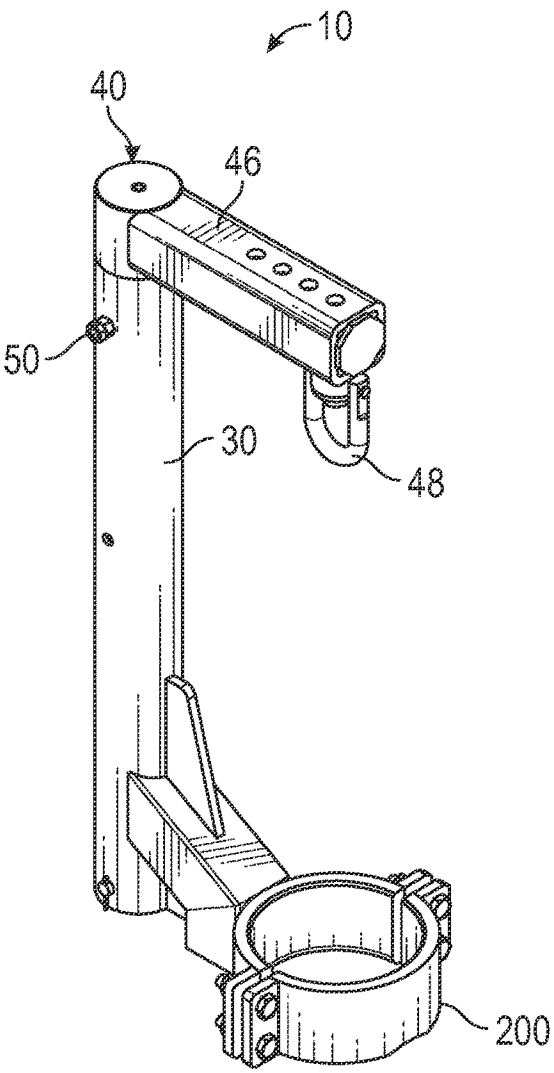
FIG. 6 is a perspective view of the embodiment of the well servicing lift apparatus of FIG. 5, from another angle.

As can be readily understood by those having relevant skill in the art, with guide pin 50 engaged in slot 44, as lift arm 40 is moved vertically upward by hydraulic cylinder 52, lift arm is initially constrained to move upwardly without rotation relative to main body 30; then when the lower, angled section of slot 44 is reached, continued upward movement of lift arm 40 forces lift arm 40 to rotate, due to the engagement of guide pin 50 in slot 44. FIGS. 6 and 7 illustrates this movement of lift arm 40, with FIG. 6 showing lift arm 40 in its lowermost position and generally aligned with mounting arm 20 or clamp 200 (and generally aligned with the wellhead), and FIG. 7 showing lift arm 40 in its uppermost position and rotated (by way of example) approximately 90 degrees from the position in FIG. 6. It can be readily understood that safety cap attached to lift arm 40 would therefore be moved out of alignment with the wellhead.

It is to be understood that lift arm 40 could be rotated any desired degree, depending upon the shape and angle of slot 44.

A Second Embodiment

Figure 10:
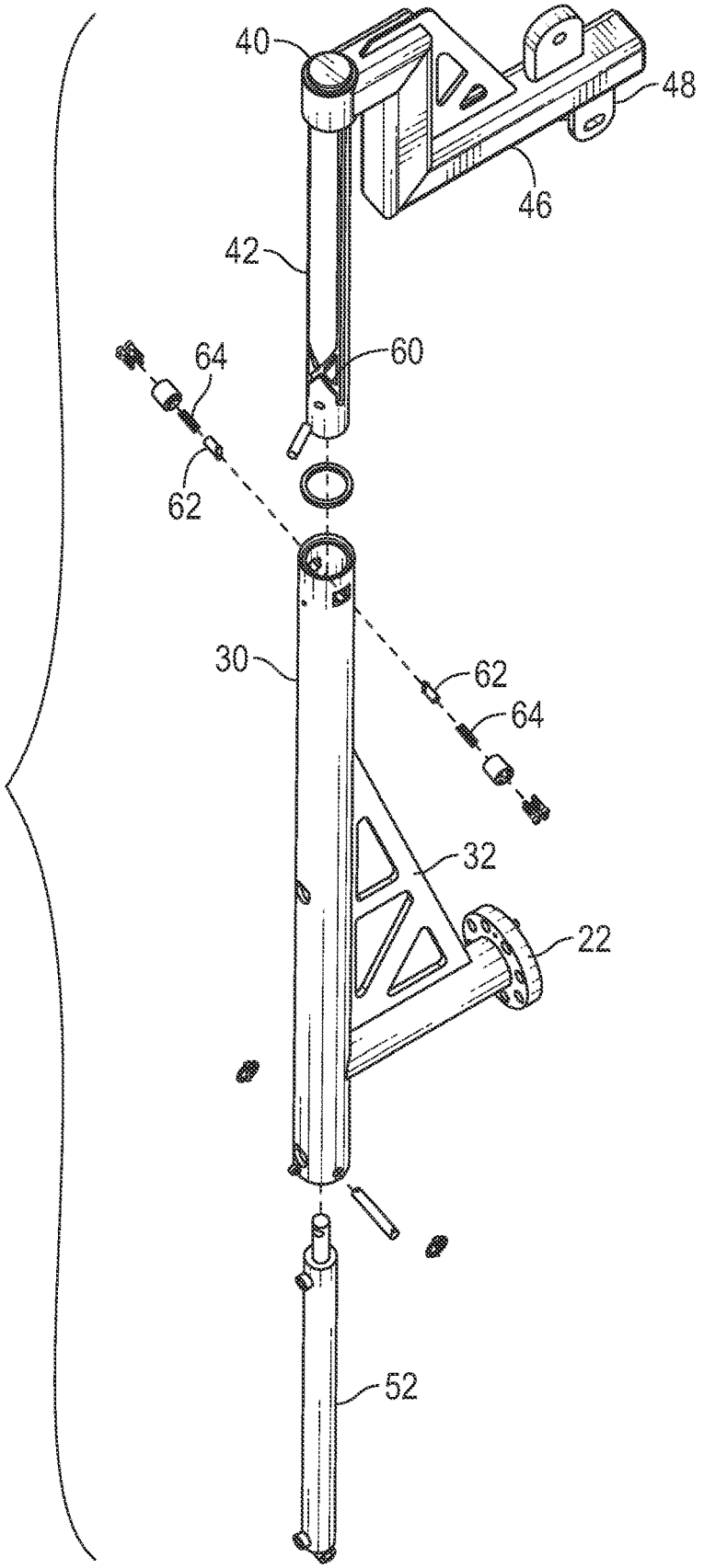
FIG. 10 is an exploded view of a second embodiment of the well servicing lift apparatus.
Figure 11:
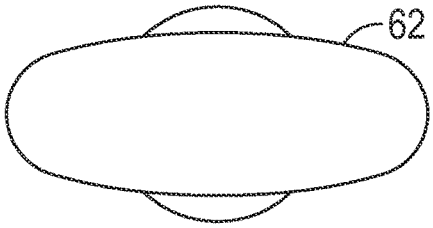
FIGS. 11-14 are various views of the cam follower.
Figure 12:
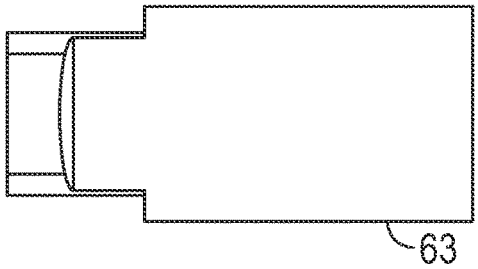
Figure 13:
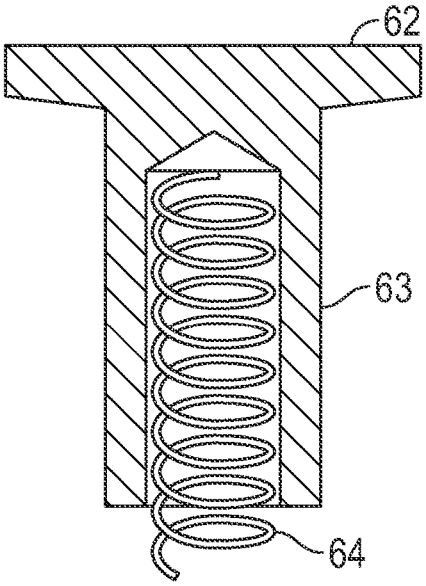
Figure 14:
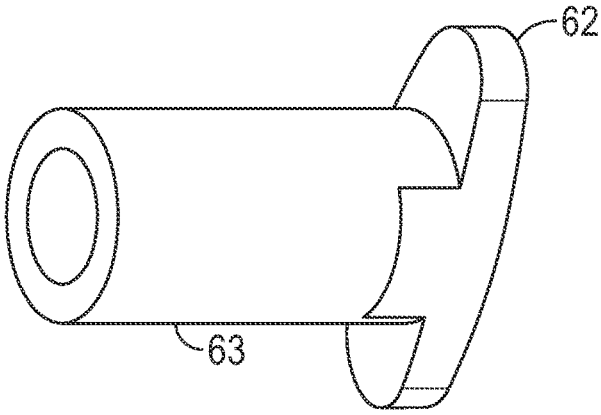

A second embodiment of lift apparatus 10 comprises a slot pattern 60 disposed on outer surface of vertical arm section 42, along with a spring biased cam follower 62 disposed in main body 30 and extending into slot pattern 62. A desired sequence of combined vertical and rotational movement of lift arm 40 may be achieved. FIG. 10 is an exploded view of the second embodiment.

Figure 16:
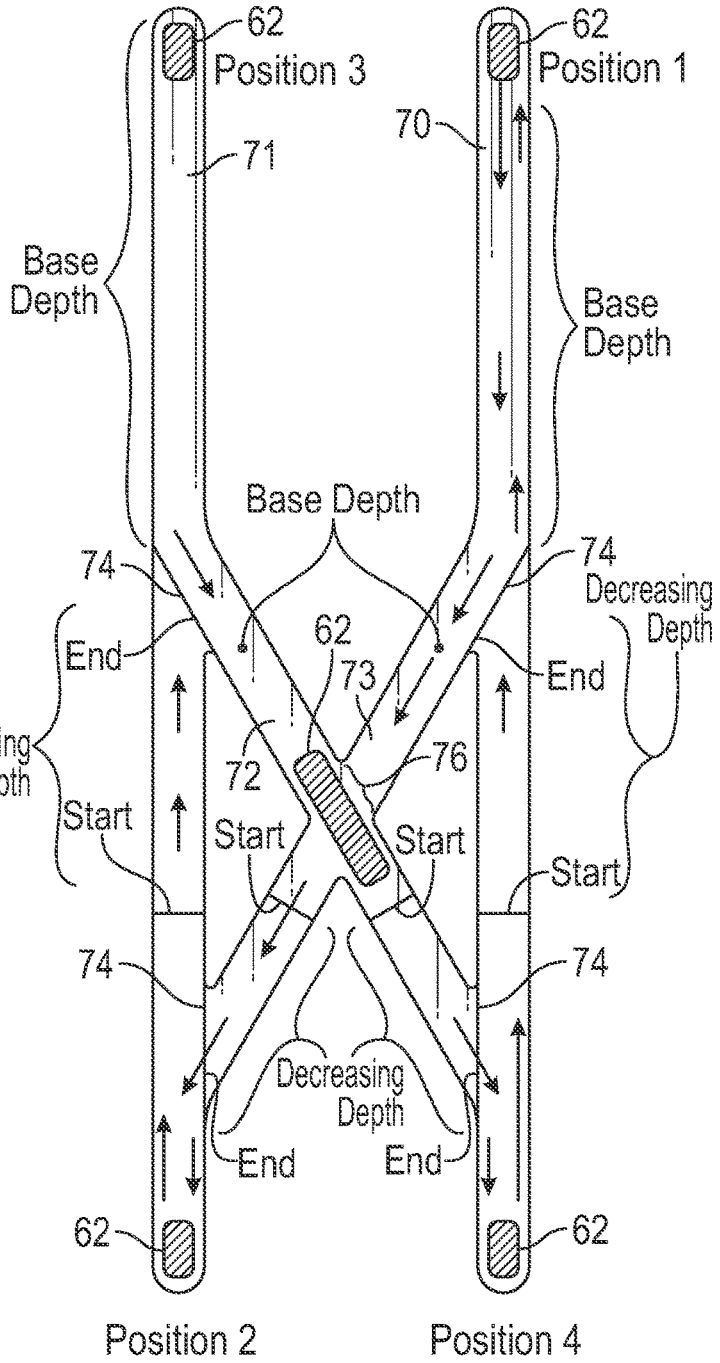
FIG. 16 is another detailed view of the slot pattern, presented in a flattened perspective so as to better illustrate the pattern.

Referring to FIGS. 17-21 (and FIG. 22, which is a bird's eye view of lift arm 40 to better illustrate the rotational movement), which show the movement of lift arm 40 in schematic form, an exemplary sequence of movement can be described. Accompanying FIG. 16 shows the position of cam follower 62 corresponding to the position of lift arm 40 in each of the drawings.

Figure 17:
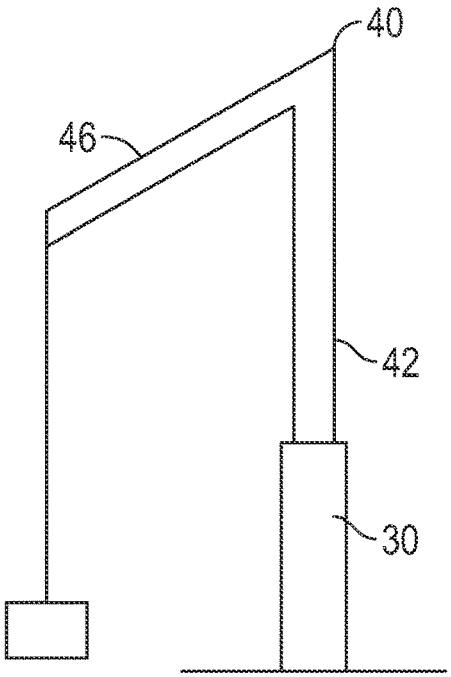
FIGS. 17-21 show the vertical and rotational movement and positions of the lift arm as it moves through a sequence of vertical and rotational movement.
Figure 18:
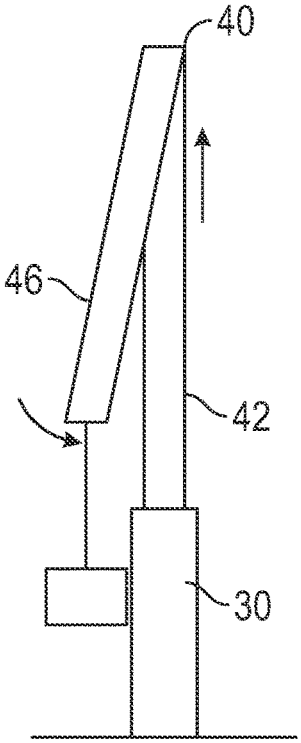
Figure 19:
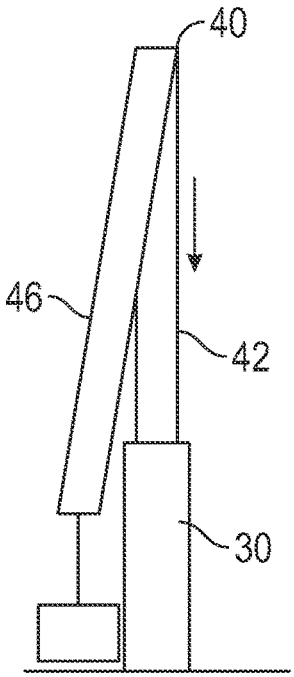
Figure 20:
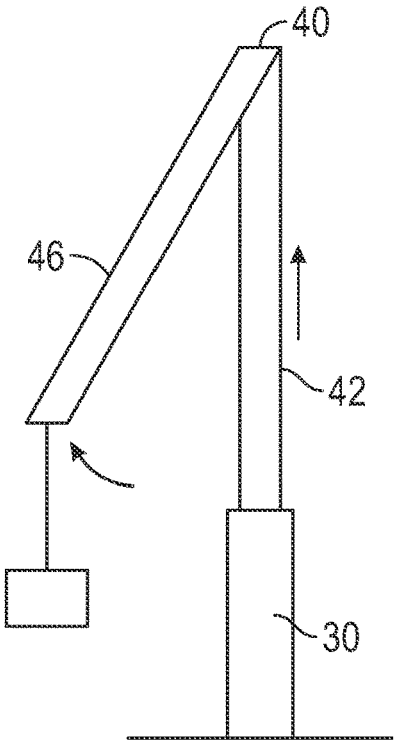
Figure 21:
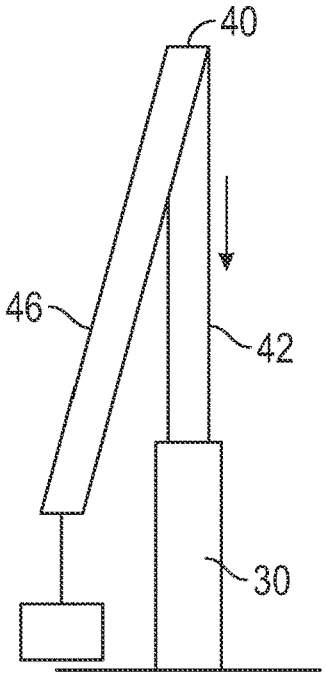
Figure 22:
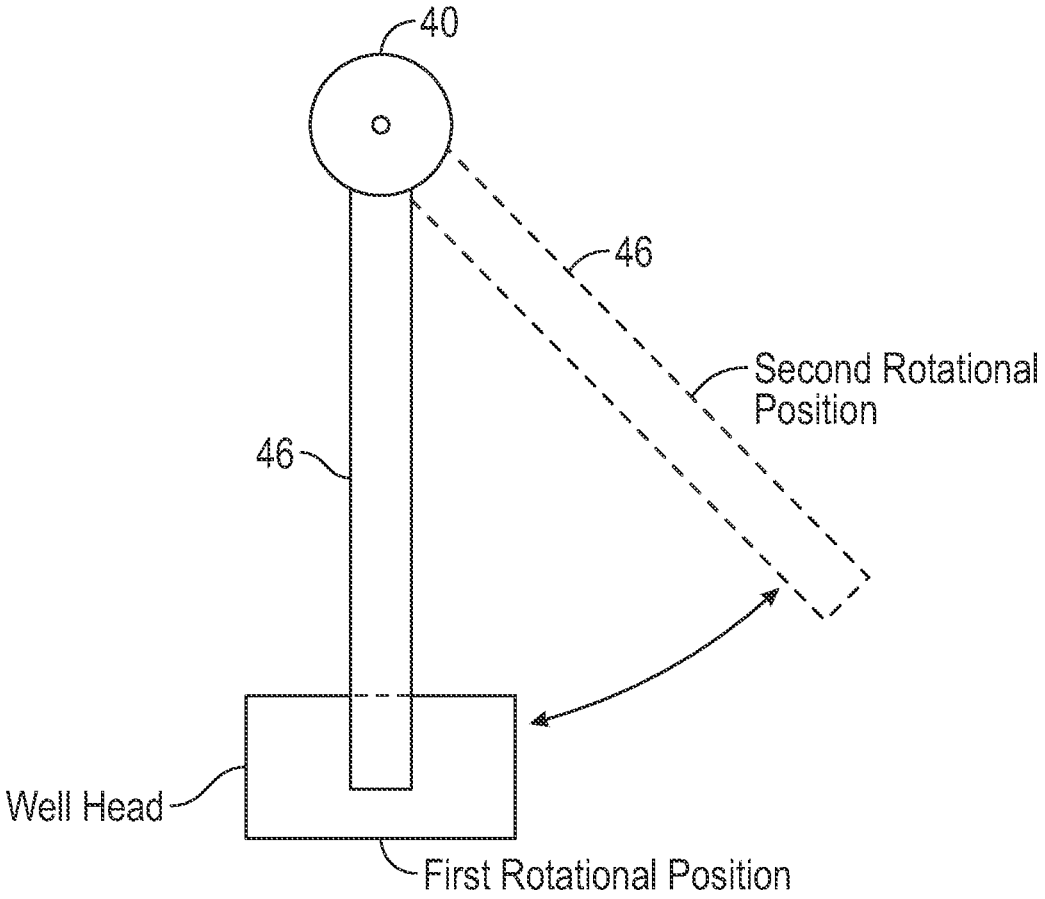
FIG. 22 is a bird's eye view of the lift arm in its first and second rotational positions, relative to a wellhead.

- as shown in FIG. 17 (cam follower 62 position 1 in FIG. 16), the starting position may be considered as lift arm 40 being in a first, lowermost vertical position, and in a first rotational position (e.g., aligned with the wellhead or wellbore being serviced)
- as shown in FIG. 18 (cam follower 62 position 2 in FIG. 16), as lift arm 40 is raised from the first vertical position to a second, uppermost vertical position, the interaction of cam follower 62 in slot pattern 60 (described further below) rotates lift arm 40 from the first rotational position to a second rotational position, out of alignment with the wellbore being serviced (see also FIG. 22; the rotation commencing once any well service equipment attached to horizontal arm section 46 of the lift arm has cleared other equipment, such as a guide funnel, etc.)
- next, as shown in FIG. 19 (cam follower 62 position 3 in FIG. 16), lift arm 40 can be lowered back to the first vertical position, while remaining in the second rotational position
- next, as shown in FIG. 20 (cam follower 62 position 4 in FIG. 16), lift arm 40 can be raised back to the second vertical position, and (via the interaction of cam follower 62 in slot pattern 60) rotated back to the first rotational position
- next, as shown in FIG. 21 (cam follower 62 returning to position 1 in FIG. 16), lift arm 40 can be lowered back to the first vertical position, while remaining in the first rotational position.

The above sequence can be repeated as desired. It is to be understood that the above description is to illustrate the movement of lift arm 40 and cam follower 62, relative to one another; in actual application, cam follower 62 remains at a fixed vertical position, while lift arm 40 moves relative to cam follower 62.

Figure 15:
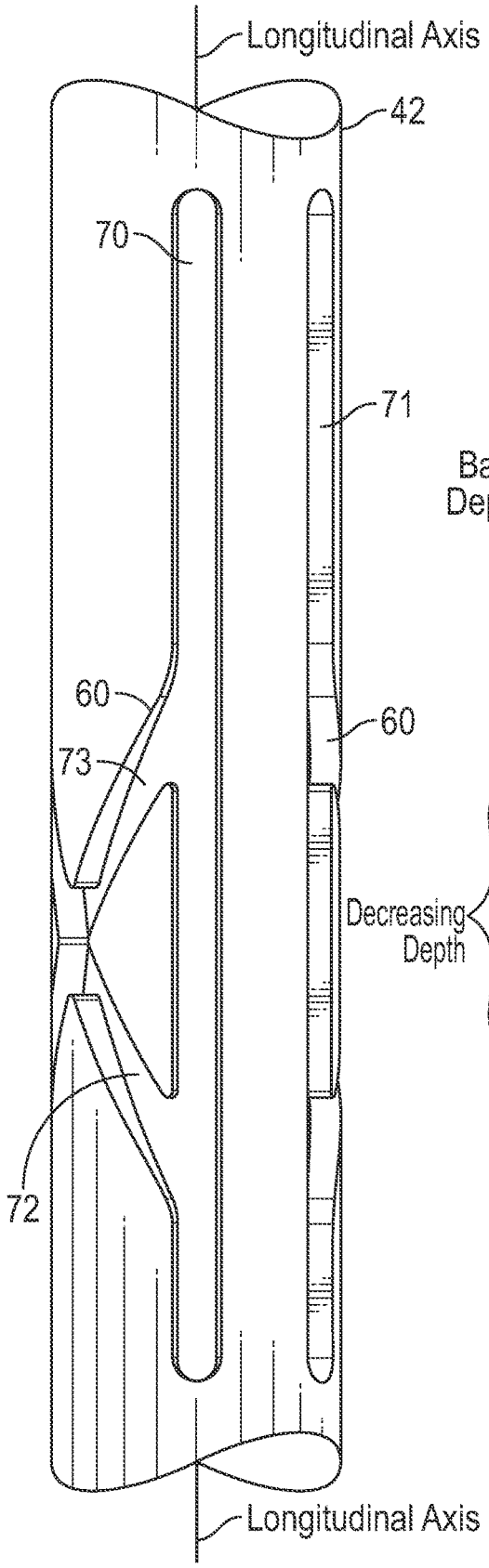
FIG. 15 is a detailed view of a section of the lift arm of the embodiment of FIGS. 9 and 10, showing the slot patterns on the outer surface of the lift arm.

The particular configuration of the slot pattern, including changes in the slot depth and resulting ledges created in the slot pattern, coupled with the configuration of the cam follower, results in the desired rotational movement. If desired, as can be seen in FIG. 15, the apparatus can comprise two (first and second) sets of slot patterns 60, generally disposed 180 degrees from one another about the circumference of the vertical arm section 42 of lift arm 40. A second cam follower 62 is provided to engage the second set of slot patterns.

It is understood that any desired well servicing equipment can be attached to and suspended from the horizontal arm section of the lift arm, for example a night safety cap, a ball launch, or other equipment.

Referring further to FIGS. 15 and 16, an exemplary embodiment of slot pattern 60 which results in the above described sequence of movement can be described. While slot pattern 60 is "wrapped around" the circumference of vertical arm section 42, for purposes of explanation a "flat" view is shown in FIG. 16. Referring especially to FIG. 16, slot pattern 60 comprises two spaced apart longitudinal slots 70 and 71, positioned generally parallel to a longitudinal axis of vertical arm section 42. Longitudinal slots 70 and 71 are connected by a pair of angled slots 72 and 73 disposed at an angle to the longitudinal axis of vertical arm section 42 and to longitudinal slots 70 and 71. Angled slots 72 and 73 generally form an X pattern. Longitudinal slots 70 and 71 and angled slots 72 and 73 comprise sections which have a base depth, and in addition both longitudinal and angled slots 70, 71 and 72, 73 comprise sections of decreasing depth less than said base depth, as noted in FIG. 16 (in effect, creating a "ramp" in the bottom surface of the slot). The intersection of the sections of base depth and the sections of decreasing depth form ledges 74, see FIG. 16, proximal the intersections of angled slots 72, 73 and longitudinal slots 70, 71. It can be understood that ledges 74 cause cam follower 62 to remain in a desired slot, as lift arm 40 goes through its sequential lifting/rotating/lowering sequence as described above, and thereby cause lift arm 40 to move to a desired rotational position as lift arm is moved between vertical positions. Since cam follower 62 is spring biased into slot pattern 60, it "snaps into" slot sections as it moves along the slots and across ledges, turns corners, etc.

It is understood that the circumferential spacing between longitudinal slots 70, 71 and other dimensional aspects of slot pattern 60 govern the degree of rotation of lift arm 40, the points along the vertical movement of lift arm 40 that rotational movement occurs, etc. A representative degree of rotation of lift arm 40 is 120 degrees, but it is understood that lesser or greater degrees of rotation are possible.

As can be seen in FIG. 16, a gap or space 76 exists at the intersection of angled slots 72, 73. Preferably, cam follower 62 is elongated, as can be seen particularly in FIGS. 11-14, in order to bridge space 76 and ensure that cam follower 62 continues to travel along the appropriate angled slot 72, 73. Cam follower 62 may also comprise a cylindrical section 63, along with a spring 64. Cylindrical section 63 permits slight rotation of cam follower 62 as it traverses its path in slot pattern 60. Spring 64 biases cam follower 62 toward and into slot pattern 60, keeping it engaged therein.

In a presently preferred embodiment, vertical arm section 42 comprises two slot patterns 60, as can be seen in FIG. 15, preferably spaced at approximately 180 degrees apart about the circumference of vertical arm section 42. While other circumferential spacings could be used, the 180 degree separation is believed to provide the best stability. It is understood that a second cam follower 62 and its related parts, including spring 64 as described above, would be provided to engage second slot pattern 60. It is further understood that more than two slot patterns 60 may be applied.

Various types of well servicing equipment can be suspended from and positioned by lift apparatus 10. Although use of lift apparatus 10 has been described in connection with lifting and positioning of a night safety cap 114, it is understood that other tools, for example a ball drop mechanism to drop actuating balls for downhole tools, could be positioned by lift apparatus 10.

Materials, Fabrication

As will be understood by those having relevant skill in the art, high strength steel or similar materials may be used for the structural components of the lift apparatus. The hydraulic cylinder is sized as appropriate to fit within main body 30 and to generate required lifting force and extent of travel. The various components may be joined by welding or other suitable means. Appropriate hoses, controls, hydraulic fluid sources, and power sources are provided.

Dimensions may be varied to suit particular settings.

CONCLUSION

While the preceding description contains many specificities, it is to be understood that same are presented only to describe some of the presently preferred embodiments of the invention, and not by way of limitation. Changes can be made to various aspects of the invention, without departing from the scope thereof.

Therefore, the scope of the invention is to be determined not by the illustrative examples set forth above, but by the appended claims and their legal equivalents.

I claim:

1. A well servicing lift apparatus, comprising:

a generally vertically disposed tubular main body with a central bore, said main body adapted to be mounted in operative position relative to a wellbore;

a lift arm slidably disposed in said main body and capable of moving vertically and rotationally therein, said lift arm comprising a vertical arm section and a horizontal arm section;

a hydraulic cylinder attached to said lift arm and adapted to move said lift arm vertically up and down, between a first, lowermost vertical position and a second, uppermost vertical position;

wherein said vertical arm section comprises an interconnected first slot pattern, comprising a plurality of connected slots, in an outer surface thereof;

wherein said main body further comprises a cam follower disposed therein and spring biased to extend into and engage with said slot;

whereby said slot and said cam follower cooperate to move said lift arm rotationally as said hydraulic cylinder moves said lift arm vertically from said first vertical position to said second vertical position and back again, said lift arm moving from said first vertical position and a first rotational position, to said second vertical position and a second rotational position; then to said first vertical position while remaining in said second rotational position; then to said second vertical position and said first rotational position; then to said first vertical position and said first rotational position.

2. The apparatus of claim 1, wherein said slot pattern comprises two spaced apart longitudinal slots, generally parallel to a longitudinal axis of said vertical arm section, connected by a pair of angled slots disposed at an angle to said longitudinal axis, said pair of slots generally forming an X pattern, wherein said longitudinal and said angled slots comprise sections comprising a base depth, and wherein said longitudinal and said angled slots further comprise sections of decreasing depth less than said base depth, the intersection of said sections of said base depth and said sections of decreasing depth forming ledges proximal intersections of said angled slots and said longitudinal slots, said ledges causing said cam follower to remain in a desired slot and thereby cause said lift arm to move to a desired rotational position as said lift arm is moved between vertical positions.

3. The apparatus of claim 2, wherein said cam follower is elongated, and has a length sufficient to span the space formed by the intersection of said angled slots.

4. The apparatus of claim 3, wherein said lift apparatus is mounted by a bolted flange.

5. The apparatus of claim 3, wherein said lift apparatus is mounted by a clamp.

6. The apparatus of claim 2, wherein said apparatus further comprises a second slot pattern, disposed about a circumference of said vertical arm section, and a second cam follower disposed in said main body and spring biased to extend into and engage with said second slot pattern.

7. The apparatus of claim 6, wherein said second slot pattern is disposed at approximately 180 degrees from said first slot pattern.

* * * * *